United States Patent [19]

Adamek et al.

[11] 4,018,905

[45] Apr. 19, 1977

[54] TACO PACKAGE

[75] Inventors: David J. Adamek; John A. Anderson, both of Minneapolis, Minn.

[73] Assignee: Hoerner Waldorf Corporation, St. Paul, Minn.

[22] Filed: Mar. 12, 1976

[21] Appl. No.: 666,434

[52] U.S. Cl. ..... 426/124; 206/45.14; 206/45.33; 206/485; 206/497; 206/499; 426/106; 426/128

[51] Int. Cl.[2] ..... B65B 23/00

[58] Field of Search ..... 426/106, 110, 119, 121, 426/124, 128, 396, 391, 392, 138, 143, 144, 132; 206/45.14, 485, 497, 499, 535, 536, 526, 45.33; 229/87 F

[56] References Cited

UNITED STATES PATENTS

| | | | |
|---|---|---|---|
| 2,256,723 | 9/1941 | Nutt | 206/45.33 |
| 2,306,624 | 12/1942 | Harris | 426/106 X |
| 2,635,528 | 4/1953 | Torres | D7/103 |
| 2,675,161 | 4/1954 | Buttery | 206/45.33 X |
| 2,892,719 | 6/1959 | Lynn | 426/138 |
| 3,349,897 | 10/1967 | Stone | 206/45.14 |
| 3,393,076 | 7/1968 | Moyer et al. | 206/45.14 |
| 3,619,216 | 11/1971 | Weinstein | 426/124 |
| 3,821,426 | 6/1974 | Slone | 426/124 |
| 3,861,576 | 1/1975 | Tolaas et al. | 426/128 X |
| 3,896,928 | 7/1975 | Forte | 206/45.14 |
| 3,922,362 | 11/1975 | Pierce | 426/106 |

*Primary Examiner*—Steven L. Weinstein
*Attorney, Agent, or Firm*—Jerry F. Best

[57] ABSTRACT

A package for taco shells of the type which are a thin crisp tortilla of a generally circular shape which is folded upon itself leaving a radius of curvature across the folded mid section of the taco shell. The package includes a nested array of the shells which are located within a tray having two diagonally oriented and inwardly folded flaps which position the shells against one another in the nested array and which, in combination with a shrink film covering over the taco shells and the tray, reduces breakage of the shells during shipment and storage.

1 Claim, 3 Drawing Figures

TACO PACKAGE

BACKGROUND OF THE INVENTION

1. Field of the Invention

This invention relates generally to particular packages for holding food products such as rigid taco shells arranged in a nested array where the package includes a paperboard tray which has features affecting the retention of the array of shells in the package.

2. Description of the Prior Art

With the advent of the popularity of Mexican food in this country, the preparation of dishes in the home has resulted in certain food items, such as taco shells, being made available commercially at relatively low cost. Taco shells are generally a thin fried tortilla which may be shipped to the consumer flat in a stack and frozen for later final preparation, or folded into the configuration used for making a taco. This second configuration presents a packaging problem because the shells are normally quite brittle and tend to break if they are packaged loosely, or if the nested array is not properly enclosed. Previous packaging techniques have included the use of a simple open top straight sided tray into which a nested array of shells are placed with a film overwrap heat shrinkable into contact with the shells and tray. This has proved less than desirable since the length of the nested array is not always constant allowing the array to shift within the package and also since there is no support for the open end of the array with the result that the exposed edges of the taco shells at the open end break from outside contact.

SUMMARY OF THE INVENTION

An improved package wherein a tray for receiving the nested array of taco shells has inwardly foldable diagonal end flaps which tend to keep the nested array in position and prevent shifting and where the diagonal flap near the open end of the taco shell array has a die cut opening to receive the lower edge of the taco shells contacting that end which provides additional support and reduces breakage, the tray and nested array being overwrapped with a heat shrinkable film.

DETAILED DESCRIPTION OF THE PREFERRED EMBODIMENT

Figure 1:
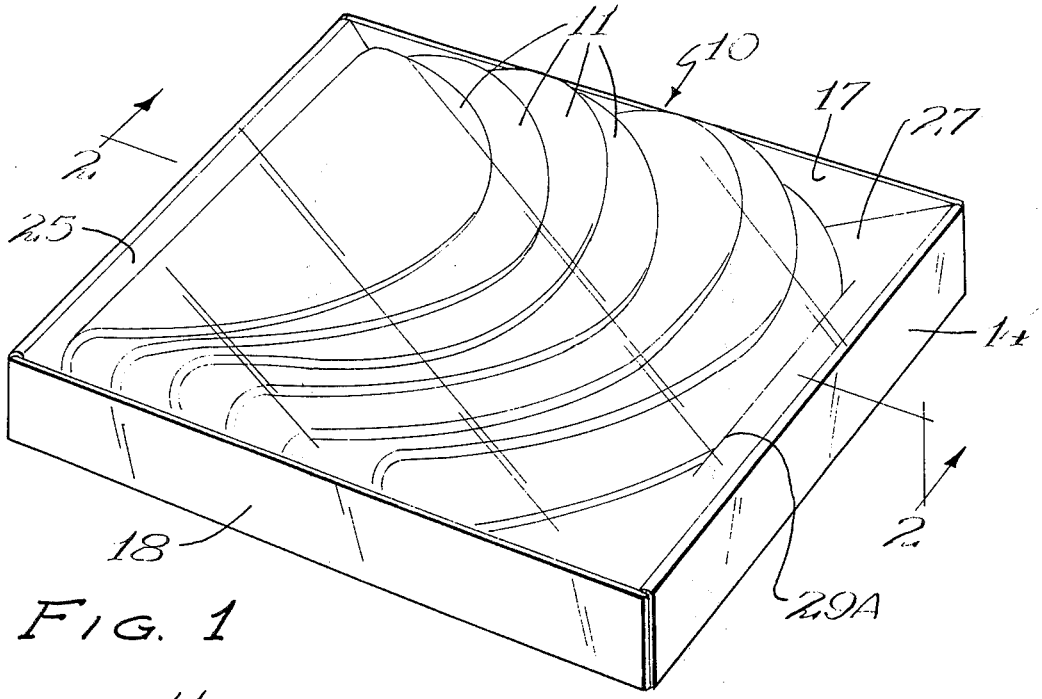
FIG. 1 shows a prospective view of a package assembled and embodying the present invention.
Figure 2:
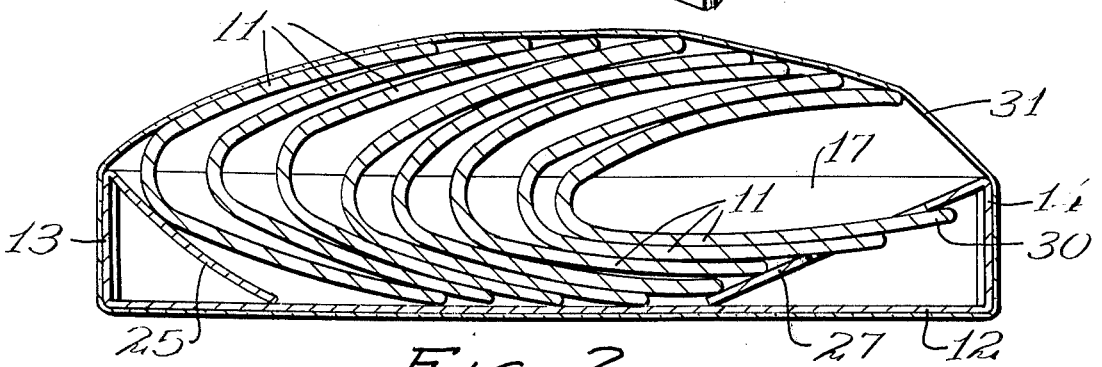
FIG. 2 is a sectional elevation view taken along section lines 2—2 in FIG. 1.

A package is shown generally as 10 in FIG. 1 and includes a nested array of a plurality of individual taco shells 11 which are of the type that are a generally circular shape and are thin, being a fried tortilla as is well known in the art of preparing Mexican foods. In this particular configuration they are folded in half so that the other ingredients of the taco such as lettuce, beans, sauce, and cheese may be inserted therein. The nested array is obtained by fitting this rounded fold into an adjacent taco shell to form a nested array such as is shown in FIG. 2. The rounded end of the array which is shown at the left of FIG. 2 has greater strength than the opposite or open end since there are multiple thicknesses and there is a vertical, although rounded, section in each shell which tends to distribute the load placed on the top of the array and also provides greater resistance to shocks or impacts to the package.

Figure 3:
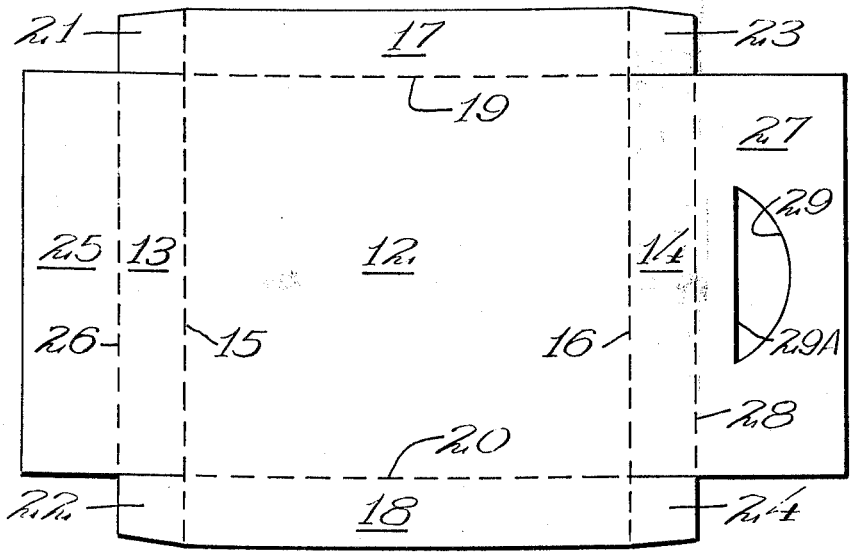
FIG. 3 is a plan view of a blank adapted to be assembled into the tray which is illustrated in FIGS. 1 and 2.

A blank which can be folded into the tray which is shown appears in FIG. 3 and consists of a generally rectangular center panel 12 with side and end walls hingedly connected thereto including end walls 13 and 14 connected along vertical hinge lines 15 and 16, respectively, with side walls 17 and 18 connected along horizontal fold lines 19 and 20, respectively. Hingedly connected to the lateral edges of the side walls 17 and 18 are glue flaps 21, 22, 23 and 24 which serve to hold the sides and ends of the tray erect in the final folded position and may be either glued or stapled or attached by other conventional means.

It should be noted that the exact configuration of the basic tray structure does not have so direct a bearing on the success of the package as does the inwardly foldable diagonal flaps which lie at either end thereof. The first diagonal folded flap is shown as 25 and is connected along a vertical hinge line 26 to the end wall 13. At the opposite end is a second inwardly foldable diagonal flap 27 which is connected along a vertical hinge line 28 to the end wall panel 14. The end wall flap 27 has an aperture 29 die cut therein and spaced outwardly from the fold line 28 so that the leading lower edge or lip 30 of at least the first taco shell 11 can be inserted under that upper edge 29A of the die cut opening 29 closest to the fold line 28 and restrict movement of the array of shells.

A heat shrinkable film 31 is overwrapped around the shells 11 and tray and shrunk to firmly hold the package together. The film centers the stack in the carton by forcing it down against the two diagonal flaps 25 and 27, at the front edge 30 of the shell 11 inserted into the aperture 29 is prevented from contacting the end wall 14 and being damaged by shocks from the end of the package. Further, the opposite flap 25 is resilient in its position and has the effect of spacing the array of shells 11 away from the bottom 12 and end 13 of the package which further reduces breakage.

We claim:

1. A package of folded taco shells, comprising:

an open top tray with a substantially rectangular bottom and vertical side and end walls, said end walls each having attached thereto an inwardly foldable flap positioned diagonally and downwardly from the top edge of said end wall panels to the top surface of said bottom panel;

a nested array of a plurality of said shells located within said tray, said shells folded approximately about a central axis allowing adjacent shells to be nested together with each shell having a rounded, closed end and an opposite open end thereby forming an array having a rounded closed end and an open end;

a first of said inwardly foldable flaps adjacent the open end of said array opposite said rounded end having formed therein a die cut opening with an upper edge;

at least the lower edge of the first of said taco shells in said array at the open end being inserted into said die cut opening and in contact with said upper edge to therefore restrict movement of the nested array;

the opposite round end of said array being positioned against said inwardly folded flap opposite said flap with said die cut opening; and a plastic film heat shrunk into close conformity with said array of shells and tray to firmly hold the package together and to center the array in the tray by forcing it down against the flaps and away from the end walls.

* * * * *